US007309402B2

(12) United States Patent
Reid et al.

(10) Patent No.: US 7,309,402 B2
(45) Date of Patent: Dec. 18, 2007

(54) DOCTOR BLADE PURGE SYSTEM

(75) Inventors: Robert A. Reid, Charlton City, MA (US); Bilal Mehmood, Sutton, MA (US)

(73) Assignee: Kadant Web Systems, Inc., Auburn, MA (US)

( * ) Notice: Subject to any disclaimer, the term of this patent is extended or adjusted under 35 U.S.C. 154(b) by 495 days.

(21) Appl. No.: 10/935,330

(22) Filed: Sep. 7, 2004

(65) Prior Publication Data

US 2005/0098292 A1 May 12, 2005

Related U.S. Application Data

(60) Provisional application No. 60/501,173, filed on Sep. 8, 2003.

(51) Int. Cl.
*D31F 1/12* (2006.01)

(52) U.S. Cl. ..... 162/281; 162/280; 15/256.5; 118/413

(58) Field of Classification Search ..... 162/281, 162/280; 15/256.5; 118/413
See application file for complete search history.

(56) References Cited

U.S. PATENT DOCUMENTS 3,526,017 A * 9/1970 Kleimola ..... 15/308
6,139,638 A 10/2000 Dubois et al.

FOREIGN PATENT DOCUMENTS

| | | |
|---|---|---|
| EP | 0 442 165 A2 | 12/1990 |
| EP | 1 123 751 A1 | 2/2001 |
| GB | 886264 | 4/1960 |
| WO | WO 2004/067839 A1 | 1/2004 |

* cited by examiner

*Primary Examiner*—Mark Halpern
(74) *Attorney, Agent, or Firm*—Gauthier & Connors LLP

(57) ABSTRACT

A doctor blade holder comprises upper and lower mutually spaced jaw components defining a slot. A doctor blade is removably retained in the slot, and nozzles in one of the jaw components are arranged to direct fluid under pressure into the slot for application to the doctor blade.

7 Claims, 2 Drawing Sheets

DOCTOR BLADE PURGE SYSTEM

CROSS REFERENCE TO RELATED APPLICATIONS

This application claims priority from U.S. Provisional Application Ser. No. 60/501,173 filed Sep. 8, 2003.

BACKGROUND OF THE INVENTION

1. Field of the Invention

This invention relates generally to doctor blade holders used in roll cleaning, tissue creping and other like applications, and is concerned in particular with the purging of contaminants that tend to accumulate in such holders.

2. Description of the Prior Art

Many roll cleaning and tissue creping applications involve the use of blade support services commonly referred to as "doctor blade holders". Often, the chemicals used in the paper-making process can cause significant contamination of the blade holder. This in turn leads to adhesion and sticking of what would normally be removable holder components, e.g., the doctor blade, backing blade and the blade support cartridge.

The sticking of such components can add to machine operating costs and loss production.

The objective of the present invention is to provide a means by which to inject anti-stick and/or release fluids directly into critical zones within the blade holder. This can serve a myriad of purposes, examples being to inject an initial anti-seize compound or coating during component installation, and/or to subsequently inject a release mechanism to break down unwanted adhesive forces.

SUMMARY OF THE INVENTION

A doctor blade in accordance with the present invention has upper and lower mutually spaced jaw components defining a slot therebetween. A doctor blade, which is preferably although not necessarily, carried in a blade support cartridge, is removably retained in the slot. Conduits in one of the jaw components serve to direct fluid under pressure into the slot for application to the doctor blade, the blade support cartridge and the adjacent surfaces of the jaw components in contact therewith.

These and other features and attendant advantages will now be described in further detail with reference to the accompanying drawings, wherein:

DETAILED DESCRIPTION OF PREFERRED EMBODIMENT

Figure 1:
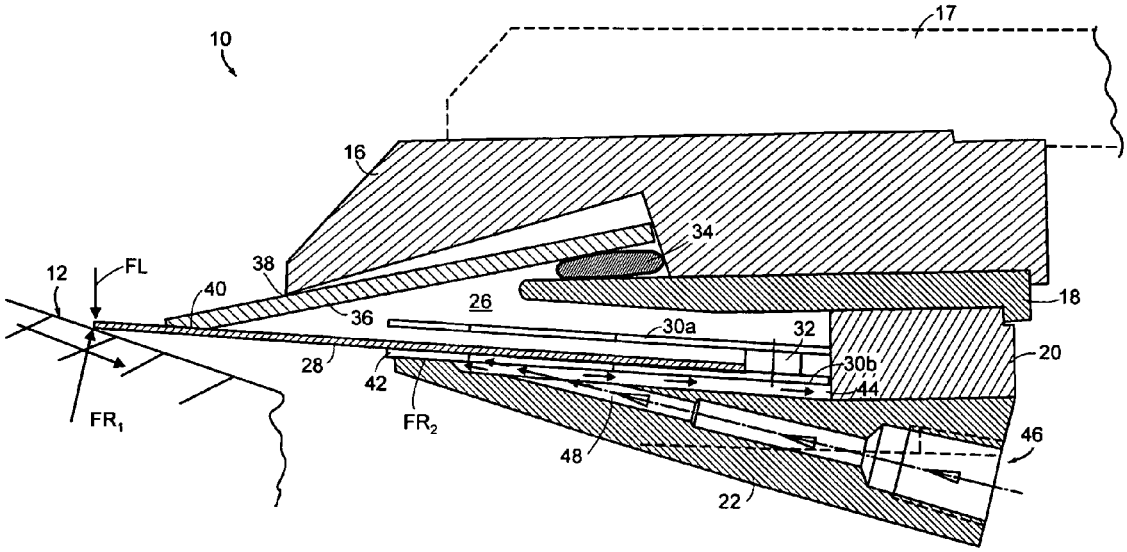
FIG. 1 is a cross sectional view taken through a blade holder in accordance with the present invention.

Referring now to the drawings, a blade holder in accordance with the present invention is depicted at 10 adjacent to a moving surface 12 to be doctored. The blade holder has stacked components, including upper jaw 16, intermediate shelf 18, spacer block 20 and a lower jaw 22.

Figure 2:
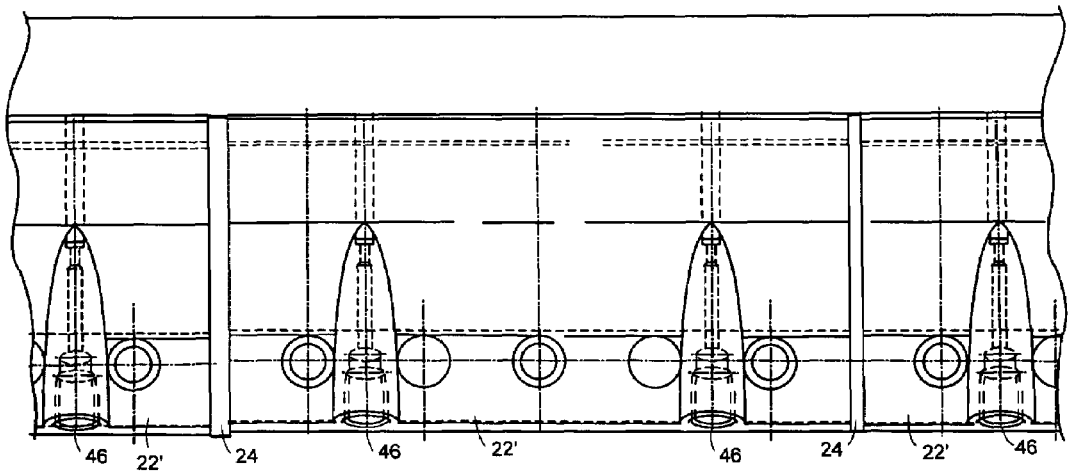
FIG. 2 is a partial view of the underside of the blade holder.

The upper jaw 16 is designed to extend continuously across surface 12, whereas as can best be seen in FIG. 2, the lower jaw 22 is divided into sections 22' spaced one from the other by gaps 24. The upper jaw is mounted to the carrier plate 17 of a typical doctor back (not shown), the construction and operation of which is well known to those skilled in the art.

The upper and lower jaws 16, 22 are mutually spaced to define a slot 26 therebetween, with the upper jaw 16 having a nose projecting forwardly beyond the lower jaw.

A doctor blade 28 is removably retained in the slot 26. The doctor blade is preferably carried in a blade support cartridge comprised of side plates 30*a* and 30*b* separated by spacers 32.

A filled reaction tube 34 is interposed between a forwardly projecting edge of shelf 18 and the rear side of a backing blade 36. When the doctor back is rotated by actuators (not shown) in a counterclockwise direction as viewed in FIG. 1, the upper jaw 16 bears against the backing blade 36 at 38, causing the backing blade to pivot about the reaction tube 34 and to bear against the doctor blade at 40, which in turn urges the forward working edge of the doctor blade against surface 12 with a loading force $F_L$. The loading force $F_L$ is opposed by a first reactionary force $F_{R1}$ exerted by surface 12, and by a second reactionary force $F_{R2}$ exerted on the side plate 30*b* of the blade support cartridge by a raised nose 42 at the front end of the lower jaw 22. A space 44 exists behind nose 42 between side plate 30*b* and the lower jaw.

The lower jaw is provided at spaced intervals with purge nozzles 46 having passageways 48 leading to the space 44, the latter being in communication with the doctor blade via openings in the side plate 30*b*. The purge nozzles provide a means by which fluids under pressure may be directed into problem zones within the slot 26 defined by the holder structure. Problem zones will typically exist adjacent to and at the areas of contact between the holder components and the doctor blade and/or blade cartridge. Fluids may be in the form of liquid, vapor or gas.

For example, liquid release agents such as silicone oil, synthetic oil and graphite, synthetic oil and polytetrafluoroethylene, could be applied via the nozzles 46 as the doctor blade and/or blade supporting cartridge are being slid into the holder. Candidate cleaning agents could include solvents, various surfactants and other detergent solutions. Steam could be used as a means of breaking down built-up chemicals and other debris within the holder. Steam pressure could be maintained during the paper-making process to minimize the build-up of contaminants while also aiding in keeping the nozzle passages clear.

Higher pressure could be used just prior to unloading the doctor structure to take advantage of higher steam volume to break down adhesive chemicals.

It should be noted that, under normal operation of the doctor blade holder when the doctor blade 28 is in contact with surface 12, the blade support cartridge (or the blade itself if a cartridge is not included) is forced or deflected against the lower jaw. Often, parts remain in this position for extended periods of time. When the blade is unloaded from surface 12, injection of high pressure air through the purge nozzles 46 could serve to assist gravity in nudging the blade or cartridge away from the lower jaw 22.

The use of a segmented lower jaw construction allowing gaps between each section provides a means to drain purged material. Use of segmentation also allows CNC machining of the lower jaw and therefore more detailed features can be applied.

The temperature of the fluids applied via the purge nozzles 46 can be adjusted, if necessary, to optimize anti-stick and cleaning functions. Use of more than one type of purge fluid at any given time is possible. For example, some nozzles along the holder length (perhaps every other nozzle) could carry steam. The remaining nozzles could supply anti-stick or lubricating fluids.

Although preferred, the embodiment herein chosen for purposes of disclosure is intended to be exemplary of others that might also incorporate the concepts of the present invention and be encompassed by the claims appended hereto. For example, the purge nozzles may be located in either or both of the jaws 16, 22 and the number, location and/or orientation of purge nozzles may be varied to optimize fluid application to the critical areas of various holder designs.

We claim:

1. A doctor blade holder comprising:

upper and lower mutually spaced jaw components defining a slot therebetween;

a doctor blade removably retained in said slot; and nozzle means in one of said jaw components, said nozzle means communicating with and being adapted to direct fluid under pressure into said slot for application to said doctor blade.

2. The doctor blade holder of claim 1 further comprising means associated with said upper jaw component for exerting a force urging a working edge of said doctor blade against a surface to be doctored.

3. The doctor blade holder of claim 2 wherein said force is opposed by a first reactionary force exerted on a working edge of said blade by the surface being doctored and by a second reactionary force exerted by said lower jaw component.

4. The doctor blade holder of claim 3 wherein said nozzle means is arranged in said lower jaw component.

5. The doctor blade holder of claim 4 wherein said upper jaw component extends continuously across the surface to be doctored, and wherein said lower jaw component is divided into sections spaced one from the other across said surface.

6. The doctor blade holder of claim 3 wherein said doctor blade is carried in a blade support cartridge, and wherein said nozzle means serves to direct fluid under pressure into said slot for application to both said doctor blade and said blade support cartridge.

7. The doctor blade holder of claim 6 wherein said second reactionary force is exerted by only a portion of said lower jaw component, with the remainder of said lower jaw component being separated from said blade support cartridge by a space, and wherein said nozzle means is in communication with said space.

* * * * *